US006112367A

United States Patent [19]

Burr et al.

[11] Patent Number: 6,112,367

[45] Date of Patent: Sep. 5, 2000

[54] ELECTRICAL APPLIANCE FOR STEAM CLEANING SMOOTH SURFACES SUCH AS WINDOWS

[75] Inventors: Jean-Marc Burr, Mulhouse; Guy Richard, Wegscheid; Rémy Dussoul, Soppe-le-Bas, all of France

[73] Assignee: Superba, France

[21] Appl. No.: 08/774,873

[22] Filed: Dec. 19, 1996

[30] Foreign Application Priority Data

Dec. 22, 1995 [FR] France ..... 95 15345

[51] Int. Cl.[7] ..... A47L 1/08

[52] U.S. Cl. ..... 15/401; 15/320; 68/222; 401/1

[58] Field of Search ..... 401/1, 2; 68/222; 15/320, 344

[56] References Cited

U.S. PATENT DOCUMENTS

| | | | |
|---|---|---|---|
| 2,849,736 | 9/1958 | Kohle | 68/222 X |
| 2,998,924 | 9/1961 | Schaeffer | 68/222 X |
| 3,082,467 | 3/1963 | Wells . | |
| 3,423,966 | 1/1969 | Mitchell | 68/222 |
| 3,584,965 | 6/1971 | Chastanier | 401/2 |
| 3,742,629 | 7/1973 | Plasko | 68/222 X |
| 3,805,425 | 4/1974 | Spoida et al. | 68/222 X |
| 4,583,260 | 4/1986 | Zai | 15/320 X |
| 5,386,612 | 2/1995 | Sham | 15/320 |

FOREIGN PATENT DOCUMENTS

| | | |
|---|---|---|
| 303300 | 11/1972 | Austria . |
| 0147627 | 7/1985 | European Pat. Off. . |
| 597617 | 11/1925 | France . |
| 1561817 | 3/1969 | France . |
| 1587080 | 3/1970 | France . |
| 2097194 | 3/1972 | France . |
| 2218867 | 9/1974 | France . |
| 2230322 | 12/1974 | France . |
| 2017487 | 10/1979 | United Kingdom . |
| 1576611 | 10/1980 | United Kingdom . |

*Primary Examiner*—Chris K. Moore
*Attorney, Agent, or Firm*—Ostrolenk, Faber, Gerb & Soffen, LLP

[57] ABSTRACT

The appliance comprises a portable and electrical self-contained assembly comprising a case of plastics material defining a housing in which there are disposed an instant steam generator operating at atmospheric pressure with a porous water storage body and electrical heater resistance elements, and a steam distributor for diffusing steam through a series of front orifices. The case is extended by a squeegee carrier fitted with a squeegee blade projecting from the front of the appliance.

25 Claims, 7 Drawing Sheets

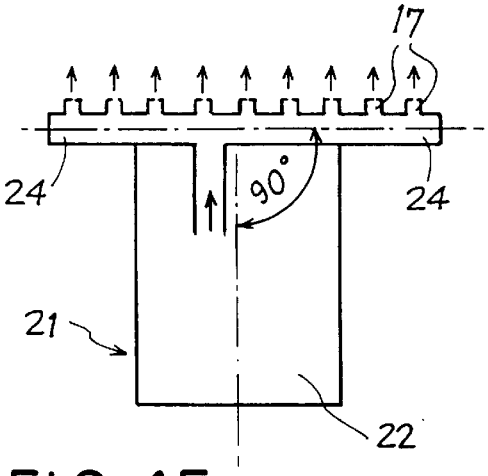
FIG_15
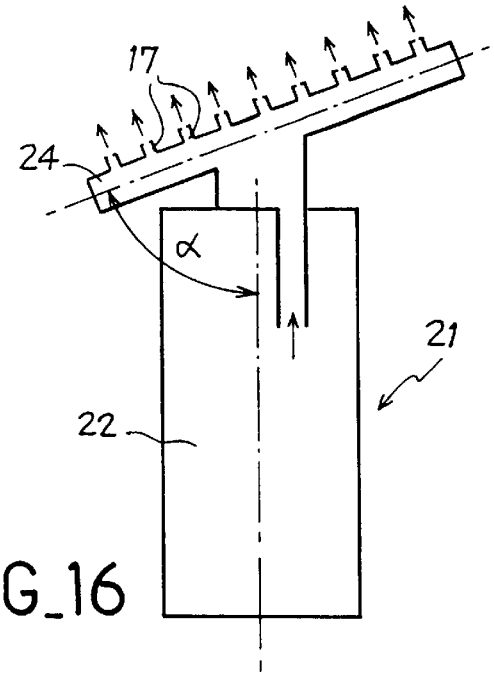
FIG_16
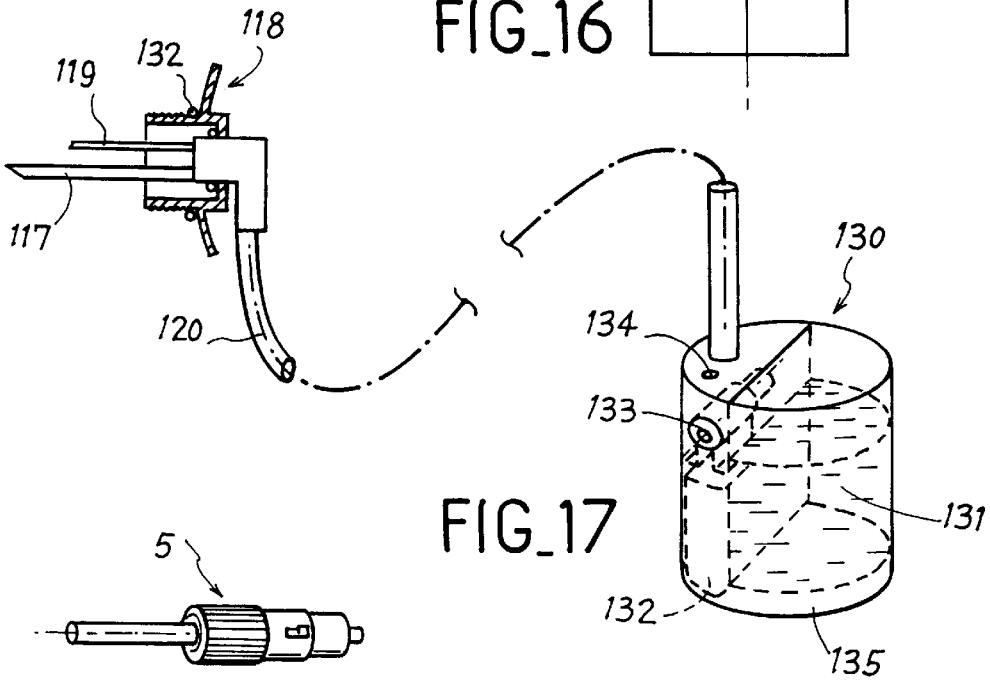
FIG_17
FIG_18
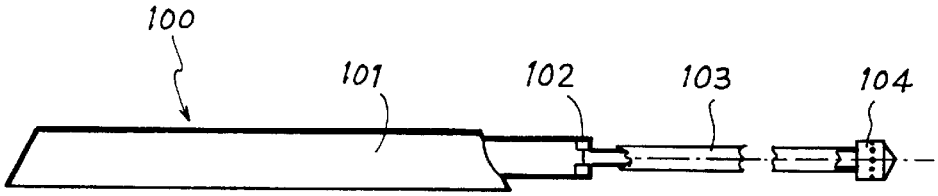
FIG_19

ELECTRICAL APPLIANCE FOR STEAM CLEANING SMOOTH SURFACES SUCH AS WINDOWS

The present invention relates to an electrical appliance for steam cleaning smooth surfaces such as windows, the appliance comprising connection means for connection to an electrical power supply, storage means for storing a supply of water, electrical heater means for heating said supply of water to produce steam, and distribution means for distributing the resulting steam to the outside of the appliance.

BACKGROUND OF THE INVENTION

Among domestic chores, cleaning windows remains an awkward manual operation which, until recently, has essentially been performed by using means such as water mixed with certain cleaning liquids or powders together with mechanical action performed by the user to unstick dirt and remove it with the help of rags or shammy leather.

Cleaning sprays have also been developed and sold to simplify or facilitate said cleaning operation.

Nevertheless, the cleaning substances used often leave a greasy film on the glass, thereby accelerating adhesion of dust on newly cleaned windows so they need to be cleaned again soon.

In industrial window cleaning, the process is basically identical, even if the skillful use of large squeegees achieves a considerable saving in time.

With the arrival of steam cleaners on the domestic market, a first steam cleaning technique for windows has been made available to households.

Steam cleaning is based on producing steam in a boiler which is heavy and which therefore remains on the ground and takes a long time to heat up, in directing the steam through a series of accessories and plastics tubes to a window squeegee, in condensing it on the windowpanes, thereby imparting a considerable amount of beat to the dust to unstick it from the glass, in using a squeegee to move the dust-laden condensed water over the glass, and in removing it from the window by wiping it off with a rag.

Such apparatus makes it possible to avoid using a cleaning substance, does not leave a film of grease on the glass or other smooth surface to be cleaned, and requires less mechanical work to detach dust.

Nevertheless, existing apparatuses present considerable drawbacks. In particular, systems for producing steam in a boiler lead to an installation that is relatively expensive, complex, and bulky, and which above all is not free from potential danger given the pressure level that obtains inside such a boiler. Such installations take a long time to put into operation given the time required for raising steam, and they cannot reach the uppermost portions of windows which are too far away from the steam-producing boiler that remains on the ground, and in any event the steam tends to expand, cool, and condense in the pipes connecting the boiler to the accessory for applying the steam. Existing apparatuses are particularly unsuitable for cleaning windows in locations that are difficult of access, e.g. on isolated motor vehicles far away from buildings.

OBJECTS AND SUMMARY OF THE INVENTION

The invention seeks to remedy the above drawbacks and to enable windows or other smooth surfaces to be steam-cleaned with all of the advantages specific to that technique while avoiding the use of apparatuses that are bulky, complex, expensive, or dangerous.

These objects are achieved by an electrical appliance for steam cleaning smooth surfaces such as windows, the appliance comprising connection means for connection to an electrical power supply, storage means for storing a supply of water, electrical heater means for heating said supply of water to produce steam, and distribution means for distributing the resulting steam to the outside of the appliance, wherein the appliance constitutes a self-contained portable assembly powered by said connection means and comprising a plastics case defining:

a) a housing for receiving both an instant steam generator including said storage means and said electrical heater means, and operating at atmospheric pressure, and a steam distributor opening out to a series of front orifices; and b) a squeegee carrier fitted with a squeegee blade projecting from the front of the appliance to wipe from a smooth surface to be cleaned the drops caused by condensation of the steam diffused from the distributor via said series of front orifices.

The portable electrical appliance of the invention requires only an electrical power supply which may be a conventional AC power supply or, for application to cleaning car windows for example, it may be a low voltage DC power supply.

The appliance of the invention retains all of the advantages of steam cleaning and in particular it avoids forming a greasy film on the surfaces to be cleaned, providing cleaning is done without adding any conventional cleaner.

The appliance is free from any danger associated with the presence of high pressure or high temperature steam and it can be made essentially out of plastics material, thereby contributing to reducing its mass and cost. Because an instant steam generator is incorporated in the body of the appliance that includes means for diffusing/spraying the steam and for wiping off the condensed steam containing dust and dirt in suspension, the appliance is ready for use very quickly.

The appliance of the invention lends itself to various embodiments having advantageous characteristics.

In a preferred embodiment, the series of steam-diffusing front orifices and the squeegee blade are substantially parallel.

Advantageously, the instant steam generator is essentially parallel to the series of steam diffusing front orifices and the squeegee blade.

Nevertheless, other configurations are also possible so long as the steam generator can be very compact.

In one such other configuration, the instant steam generator is essentially perpendicular to the series of steam diffusing front orifices and the squeegee blade.

In yet another possible configuration, the instant steam generator is at an angle lying in the range about 30° to about 60° relative to the mean direction defined by the series of steam diffusing front orifices and by the squeegee blade.

Advantageously, the case of plastics material also defines a handle situated at the back of the appliance adjacent said housing, on the side thereof opposite to the side with the squeegee carrier.

The stick-shaped handle facilitates use while keeping the steam generator further away from the hand of the user.

According to a particular characteristic of the invention, the appliance comprises an instant steam generator of low thermal inertia comprising a capillary storage body for storing in divided form all of the supply of water to be evaporated, said capillary body being compressed around the electrical heater means to obtain low thermal inertia.

In such an embodiment, there is no expensive regulator member such as a pressure-stat or an electrically controlled valve, and in all cases steam can be obtained almost instantaneously after first heating.

The electrical heater means comprise a switch and a cartridge including at least one ceramic resistance element.

By using one or more ceramic resistances as heater elements, it is possible to adapt heating automatically to the quantity of water present and to avoid adding other safety members such as additional means for determining the presence of water, thermostats, or fuses.

In a particular embodiment, the instant steam generator includes a first enclosure for holding the capillary body compressed around said cartridge, said first enclosure having perforations to allow water to penetrate into the capillary body and to allow steam to escape therefrom.

The first enclosure is fitted at one end with a cover ensuring geometrical and sealed positioning of the said cartridge.

The first enclosure comprises two perforated half-shells that are united by link means.

The instant steam generator includes an outer second enclosure co-operating with said cover to form a shell that is sealed with the exception of an orifice for extracting steam, centering means being provided to center the outer second enclosure relative to the first enclosure so as to leave an empty space between them.

It will be observed that the empty space between the first and second enclosures can receive water which can be expelled from the capillary body when it is heated and produces steam, while enabling said water to return to the capillary body when the steam generating process is interrupted. In addition, the empty space also makes it possible to collect excess water during filling, it being possible to dispose of said water not contained in the porous body prior to putting the appliance into operation.

At one end, remote from the end of the first enclosure that is fitted with a cover, the second enclosure includes removable sealed closure means making it possible selectively to fill the inside of the steam generator with water, to expel excess water, and to close the second enclosure hermetically.

Advantageously, the steam outlet orifice is formed in a projecting portion of the second enclosure, said projecting portion extending inside the second enclosure towards the center of the steam generator in the form of a reentrant portion complementary to the first enclosure, thereby preventing or reducing penetration of any residual drops of water into the steam distributor.

In a particular embodiment, the steam distributor comprises a part defining an elongate cavity applied to the second enclosure for collecting the steam coming from said steam outlet orifice, the steam distributor including a series of nozzles inserted in sealed manner in said series of front orifices formed in the case.

The case of plastics material is advantageously made as two portions provided with means enabling them to be closed together in sealed manner, e.g. by a hot blade heat-sealing method.

The squeegee carrier is constituted by plate-shaped extensions of the two portions of the case overlying said series of front orifices, the squeegee blade being clamped between said plates.

The squeegee blade is advantageously made of flexible material.

In this case, it is advantageous for the squeegee blade to include sloping ribs in its terminal portion in the vicinity of two lateral ends, the ribs being disposed essentially perpendicularly to the main face of the squeegee blade and extending lateral chamfered faces of said terminal portion.

The inclined ribs formed at the ends of the squeegee blade of flexible material serve in a normal downward movement to prevent droplets of steam escaping from the ends of the squeegee, thereby preventing dirty vertical marks being created on portions that have already been cleaned.

Nearly the same result can be obtained merely by providing simple chamfered faces at an angle a lying in the range 10°to 45°, and preferably of 30° , relative to the horizontal in the vicinity of the two lateral ends of the terminal portion of the squeegee blade, without using additional ribs.

The squeegee carrier may also include a strip of spongy fabric disposed parallel to the squeegee blade. This strip of spongy fabric can be disposed above the squeegee blade. Nevertheless, it is also advantageous to place spongy fabric beneath the flexible portion of the squeegee blade and partially in contact therewith over its entire length, thus making it possible for the spongy fabric to collect dirty water and thus minimize horizontal squeegee stop marks and also minimize the need to clean the squeegee frequently.

In some cases, the squeegee made of flexible material can be replaced by a squeegee blade of rigid material to scrape off semisolid matter such as ice, snow, or frost as partially melted by the steam.

Optionally, the appliance may further include accessories enabling it to perform additional functions, in particular for concentrating the steam in order to obtain a jet enabling more vigorous extra cleaning to be performed in a localized zone.

Under such circumstances, the appliance further comprises a steam collector to be positioned over said series of front orifices to collect the steam in a cavity and to apply said steam in concentrated manner through a tubular extender connected to an outlet orifice from said cavity and having a localized steam spray head at its free end.

Advantageously, a membrane that is proof against water and permeable to steam is interposed between the cavity and the extender that is removably connected to the cavity.

This characteristic makes it possible for the cleaning appliance of the invention to be used to help out in certain other applications, in particular in cars (for example the steam can be used to heat the contents of a receptacle inside a vehicle).

According to another optional characteristic of the invention, the appliance further includes means for adding a scented additive to the steam issued via the series of front orifices.

According to yet another particular characteristic of the invention, enabling the operating time of the appliance to be increased by using a larger supply of water while retaining the function of raising steam as close as possible to its point of use, the appliance further includes a removable device for automatically filling the instant steam generator with water, said automatic filler device comprising: a plug capable of being positioned through the case to feed water to the storage means for storing a supply of water via an injection tube mounted on the plug and to take a signal representative of need for water to be fed by means of a probe for detecting dryness and also mounted on the plug; a flexible lead including a hose connected to the injection tube; a rechargeable battery or a plug for connecting to an electrical power supply network; and an electric pump and means for controlling the pump connected by connection cables to the probe, the electric pump being actuated when the probe detects dryness in the storage means for storing a supply of water.

BRIEF DESCRIPTION OF THE DRAWINGS

Other characteristics and advantages of the invention appear from the description of particular embodiments given as examples with reference to the accompanying drawings, in which:

FIG. 15 is a diagrammatic view of a steam generator and of a steam distributor having special relative positions in a variant embodiment of the invention;

FIG. 16 is a diagrammatic view of a steam generator and a steam distributor having special relative positions in another variant embodiment of the invention;

FIG. 17 is a diagrammatic view of a water feed system capable of co-operating with the appliance of the invention;

FIG. 18 is a perspective view of electrical connection means for connecting the appliance of the invention to a cigar lighter type outlet; and FIG. 19 is a section view of a steam collector that can be used in combination with the appliance of the invention.

MORE DETAILED DESCRIPTION

Figure 1:
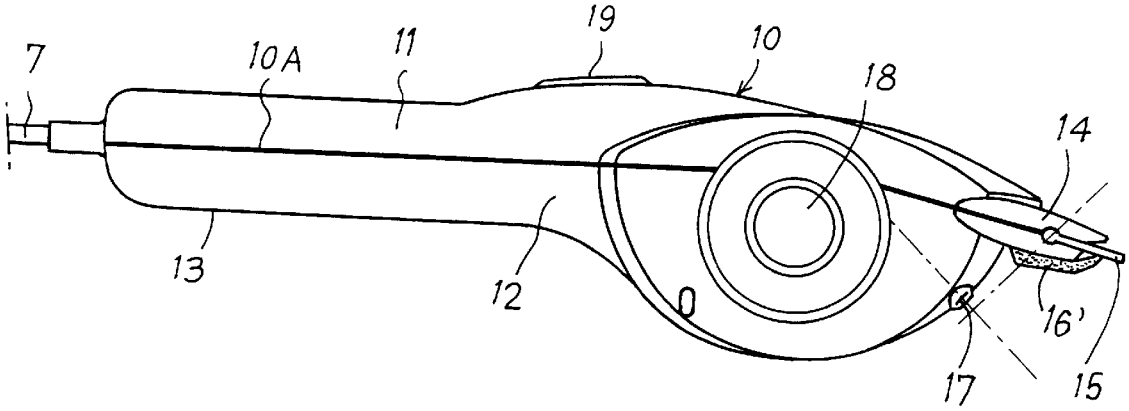
FIG. 1 is a side view of an example of a portable and electrical steam-cleaning appliance of the invention.
Figure 2:
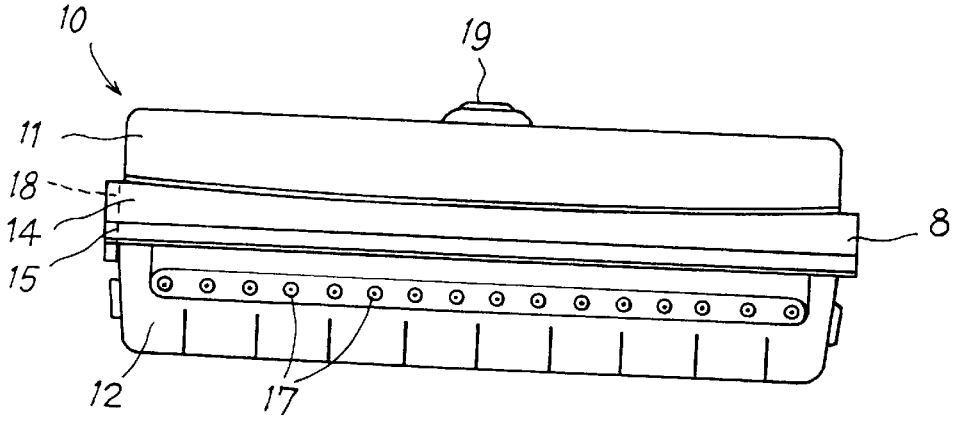
FIG. 2 is a front view of the FIG. 1 appliance.

With reference to FIGS. 1 to 5, there can be seen an example of a portable and electrical appliance for steam cleaning surfaces 1 such as windows, the appliance essentially comprising a case 10 of rigid plastics material comprising a bottom portion 12 and a top portion 11 connected together in sealed manner along a separation line 10A, e.g. by a hot blade heat-sealing method. The case 10 is terminated at its rear end by a stick-shaped handle 13 that makes the appliance easy to grasp. The rear end of the handle 13 receives a cable 7 for connection via a standardized outlet to a conventional AC mains supply or via a special plug 5 (FIG. 18) to an outlet, e.g. of the cigar lighter type or the like, of a low voltage DC power supply, e.g. of the 12 V type. The cable is connected inside the appliance to a switch 9 that includes a control knob 19 located, for example, on the handle 13 on the top of the case 10. An electrical heater member 30 disposed inside the case 10 is powered from the switch 9 when it is in its on position.

The case 10 defines a housing 20 that extends transversely relative to the handle 13. The housing 20 may be defined by the cradle-shaped bottom portion 12 of the case 10, being closed by the top portion 11 of the case 10 which is flatter in shape and constitutes a cover. A modular steam generator 21 is disposed in the housing 20, transversely relative to the handle 13.

Figure 6:
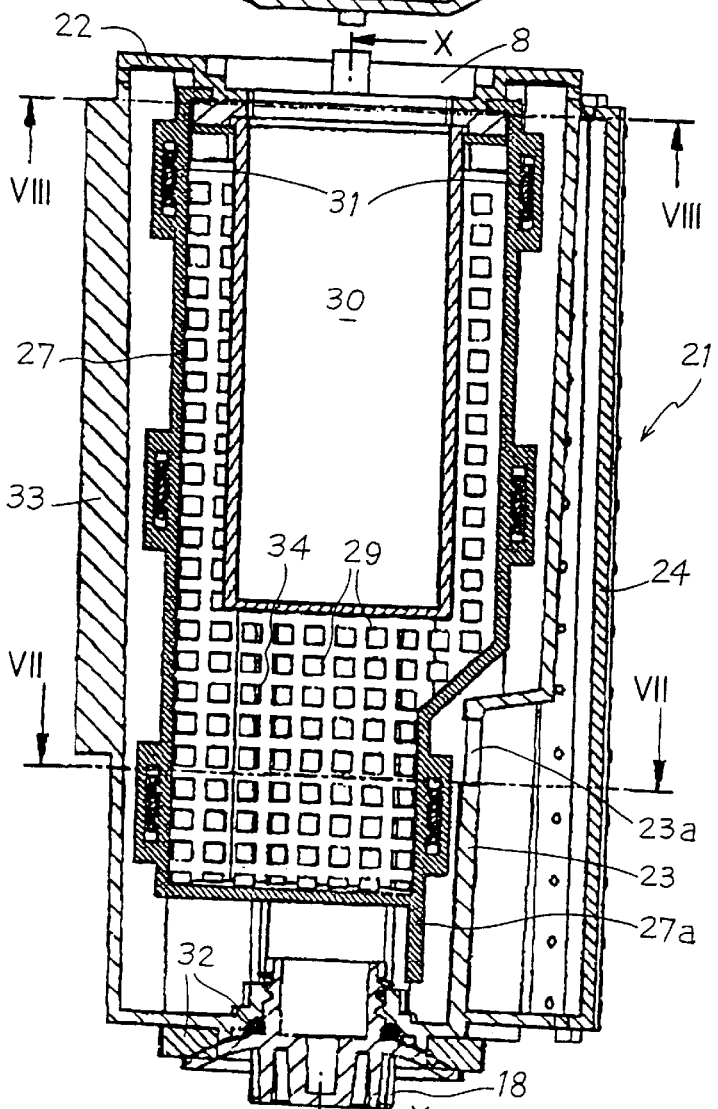
FIG. 6 is an axial section view of an example of an instant steam generator usable in the FIG. 1 appliance.
Figure 10:
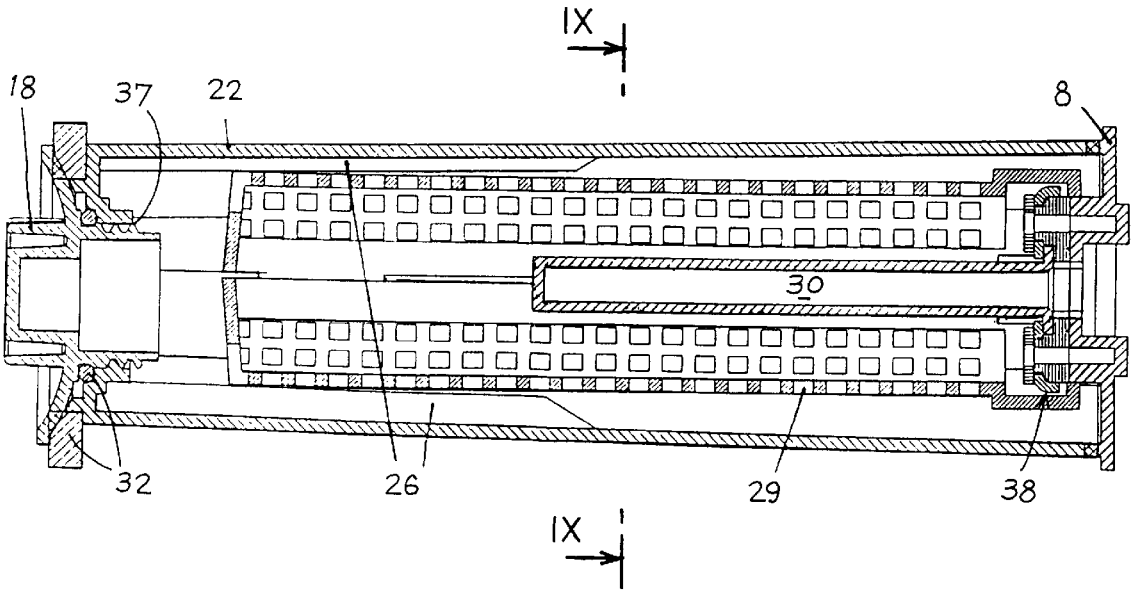
FIG. 10 is a section view on line X—X of FIGS. 6 and 9.
Figure 11:
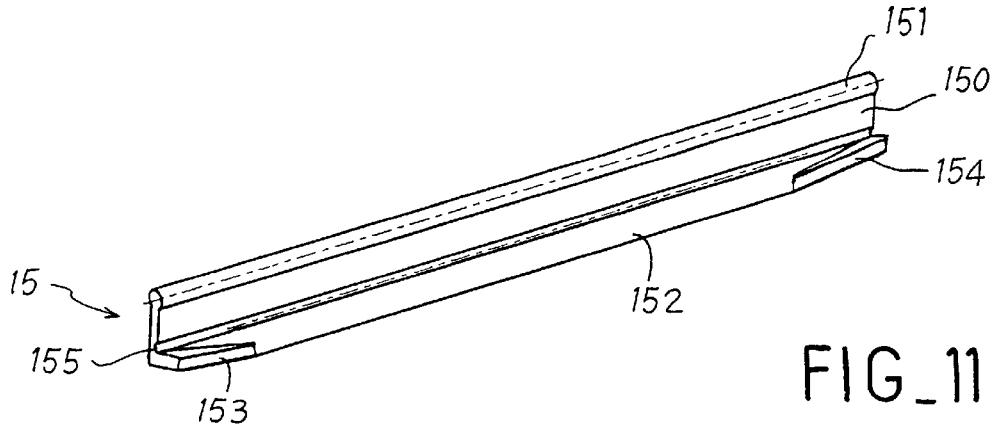
FIG. 11 is a perspective view of a flexible squeegee blade usable in an appliance of the invention.
Figure 12:
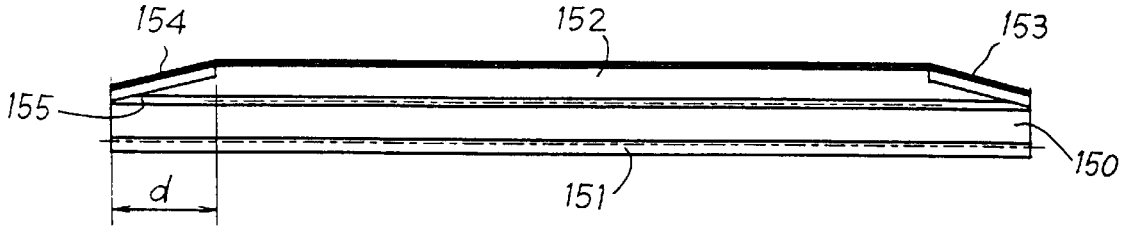
FIG. 12 is a plan view of the FIG. 11 squeegee blade.
Figure 13:
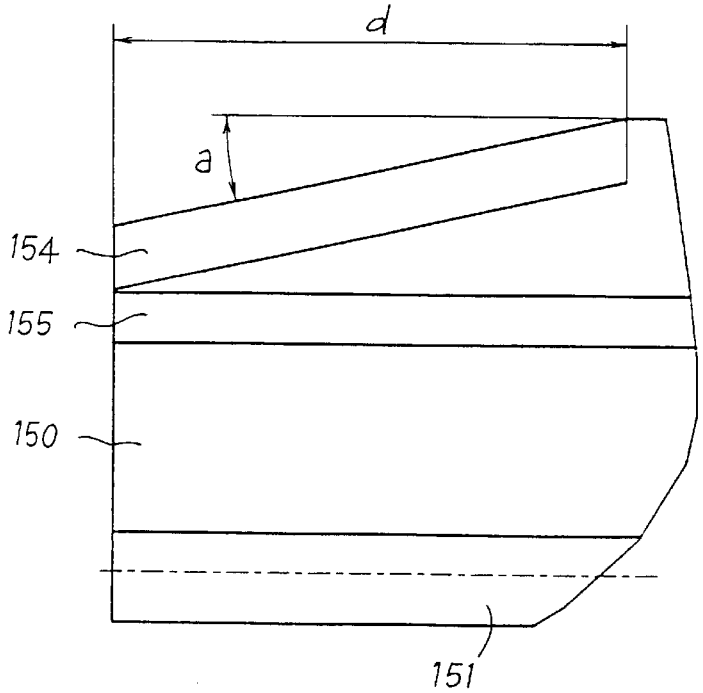
FIG. 13 is a plan view showing a detail of the FIG. 11 squeegee blade.
Figure 14:
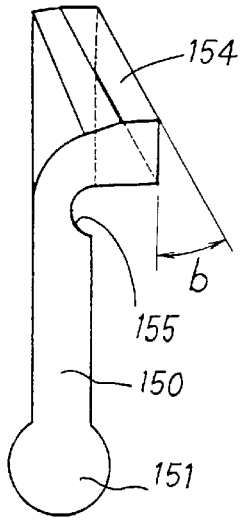
FIG. 14 is a side view showing a detail of the FIG. 11 squeegee blade.

The steam generator 21 may be closed at one of its end by a plug 18 engaged in an orifice formed in the side wall of the case 10, e.g. in the bottom portion 12 thereof, and be connected directly to an opening 37 for filling and emptying an outer shell 22 of the steam generator with water. Sealing gaskets 32 are interposed between the plug 18 and the opening 37 to prevent any escape of steam through the opening 37 (FIGS. 6 and 10).

The outer enclosure 22 of the steam generator 21 has a cover-forming portion 8 at its other end remote from the plug 18, which portion 8 is secured in sealed manner to the outer enclosure 22 and serves to position the electrical heater means 30 within the steam generator 21 while leaving a space to provide a connection between the electrical heater means 30 and the switch 9.

The outer enclosure 22 of the steam generator 21 is positioned in its housing 20 by ribs 3 and 6 formed respectively on the inside faces of the bottom and top portions 12 and 11 respectively of the case. These ribs 3 and 6 serve to position the outer enclosure 22 properly while minimizing its zones of contact with the case 10, thereby contributing to minimizing the temperature thereof.

Figure 5:
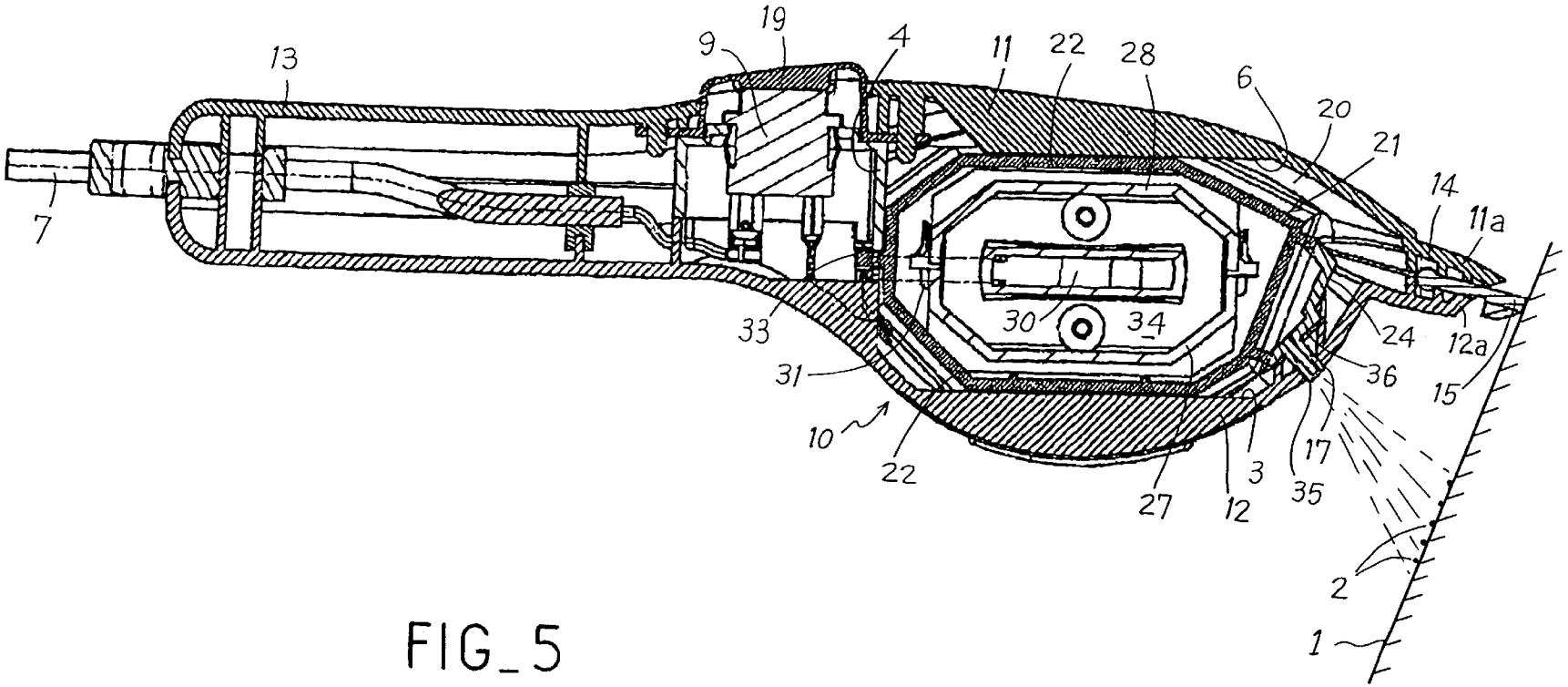
FIG. 5 is a section view on line V—V of FIG. 3.
Figure 8:
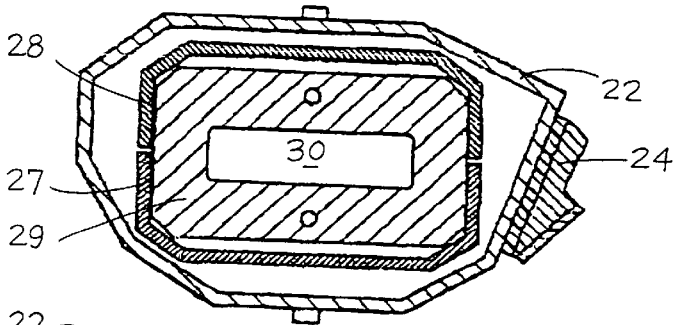
FIG. 8 is a section view on line VIII—VIII of FIG. 6.

As can be seen in FIGS. 1 to 3 and 5, the top and bottom portions 11 and 12 of the case 10 extend forwards beyond the housing 20 to form two clamp-forming flattened surfaces 11*a* and 12*a* constituting a squeegee carrier 14 in which a squeegee 15 is insertable, either removably or permanently. The squeegee 15 projects in front of and over a series of steam-projection orifices 17 formed in the bottom portion 12 of the case and advantageously in alignment in a direction parallel to that of the squeegee 15. FIG. 5 shows a smooth surface to be cleaned 1 onto which steam is projected by the orifices 17, said steam condensing to form droplets 2 which can subsequently be removed with the squeegee.

Figure 3:
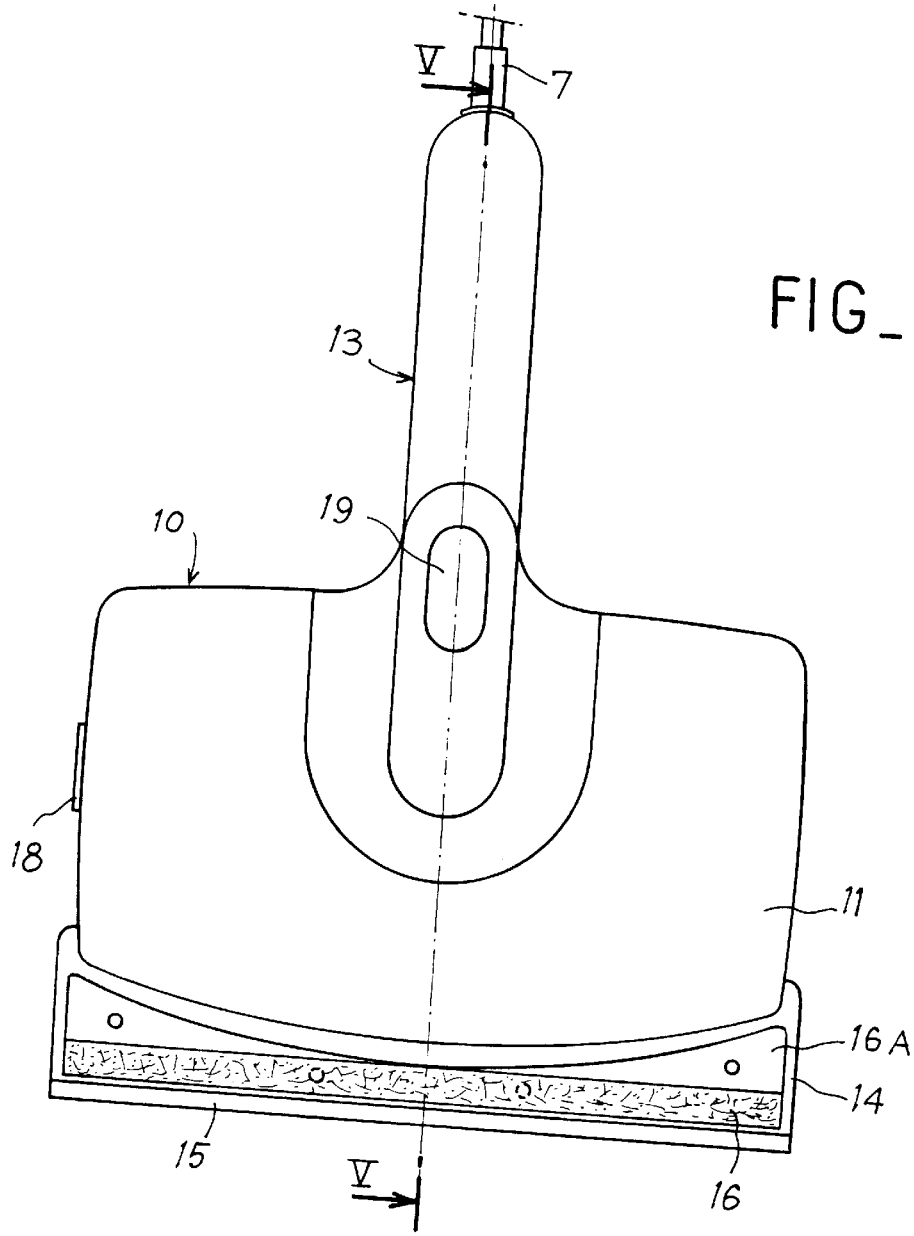
FIG. 3 is a plan view of the FIG. 1 appliance.
Figure 4:
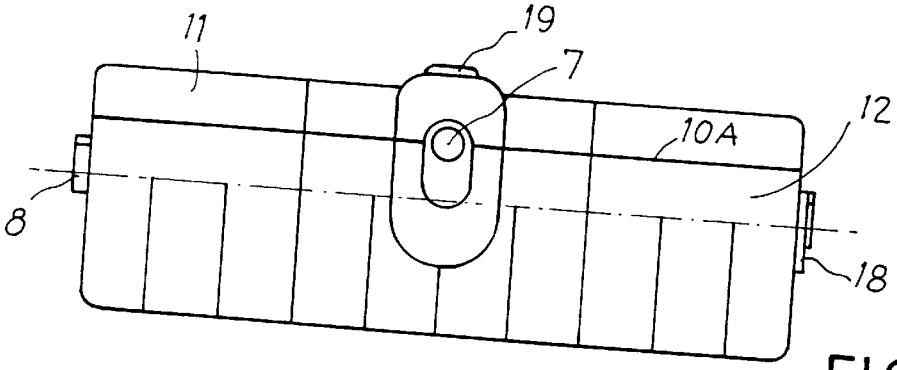
FIG. 4 is a back view of the FIG. 1 appliance.

Optionally, as shown in FIG. 3, a strip of very spongy fabric 16 may be applied to a piece 16A of plastics material, itself fixed on the top portion of the squeegee carrier 14, e.g. removably by snap-fastening. At the end of a wiping operation, the strip 16 serves to sponge away the water droplets 2 as connected together by the squeegee 15 at the bottom of the window or other smooth surface 1 to be cleaned, by turning the appliance upside-down. An equivalent result can be obtained by using a spongy fabric 16' applied to the bottom portion of the squeegee carrier 14' the spongy fabric 16' being in contact with the squeegee blade 15 along its entire length so as to minimize horizontal squeegee stop marks (FIG. 1).

The steam generator 21 is described below in greater detail with reference to FIGS. 5 to 10.

The steam generator 21 comprises a heater body 30 in the form of a cartridge containing at least one PTC type ceramic electrical resistance element. The cartridge 30 is fixed in sealed manner to the cover 8 by means of a high temperature gasket such as a viton gasket 38 which also makes it possible to pass the electric wires that need to be connected to the switch 9 via the cover 8.

Figure 7:
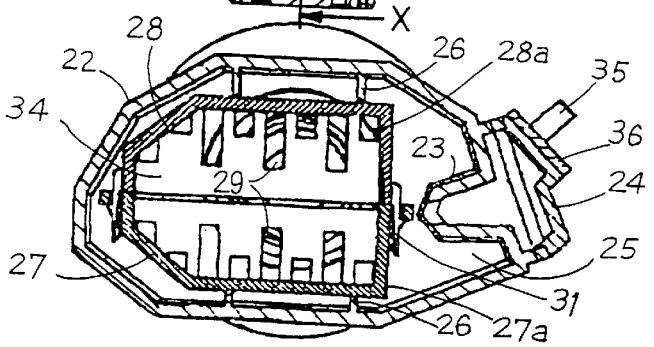
FIG. 7 is a section view on line VII—VII of FIG. 6.
Figure 9:
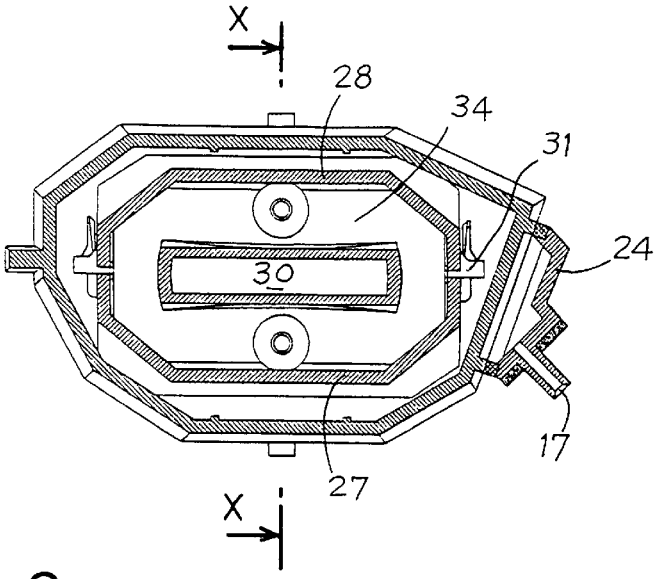
FIG. 9 is a section view on line IX—IX of FIG. 10.

A subdivided porous or capillary body 34 is held tightly around the cartridge 30 by two half-shells 27 and 28 pierced by openings 29 to allow water to penetrate into the body 34 and steam to escape therefrom. The two half-shells 27 and 28 are fixed together by screws or, as shown in the drawing, by clips 31. The two half-shells 27 and 28 are secured to the cover 8 and are positioned inside the outer enclosure 22, leaving an empty space because of the ribs 28 formed on the inside wall of the enclosure 22 (FIG. 7). The empty space between the half-shells 27 and 28 and the outer enclosure 22 constitutes a small steam supply.

A steam outlet orifice 23*a* is formed in a projecting portion 23 of the enclosure 22. The projecting portion 23 extends into the inside of the enclosure 22 near the center of the steam generator into a complementary reentrant portion 27*a,* 28*b* formed by the capillary body 34 and the half-shells 27*a,* 28*a* (FIGS. 6 and 7). Whatever the position of the appliance, this disposition serves to prevent excess water droplets that are not contained in the porous body 24 but that collect in the empty space between the half-shells 27, 28 and the enclosure 22 from being swept away towards the steam distributor 24. With reference to FIG. 7, and assuming that the appliance is disposed in such a manner that the distributor 24 is in the least favorable position, i.e. pointing downwards, the excess water collects on either side of the reentrant portion 23, and the orifice 23*a* offset towards the axis of the steam generator 21 does not run any risk of picking up water droplets together with the steam.

The steam distributor 24 comprises a piece of thin-walled plastics material (e.g. having a wall thickness of less than 2 mm) that is thermally and electrically insulating, as are the half-shells 27 and 28 and the enclosure 22. The steam distributor 24 defines an elongate cavity and is applied to the enclosure 22 to collect the steam coming from the steam outlet orifice 23*a*. The steam distributor 24 has a series of nozzles or small hollow cylinders 35 that are positioned in the steam outlet orifices 17 formed through the case 10. The steam distributor 24 is sealed relative to the case 10 by a gasket 36 preventing any projection of water via the nozzles 35 from penetrating into the inside of the case 10 other than within the enclosure 22 of the steam generator.

It will be observed that the use of very thin walls for the enclosures 27, 28, and 22, and for the distributor 24, and the use of materials that are electrically and thermally insulating minimizes contact between the steam and cold portions on which it would condense, and makes it possible to separate clearly zones that contain water or steam from zones that contain electrical connection wires or components. Mechanically, co-operation between the various elements having different functions is naturally possible. Thus, FIG. 5 shows a case for protecting the switch 9 which co-operates with a rib 33 of the enclosure 22 to hold it more securely in place.

The above-described appliance has the following main advantages.

The appliance is made mainly out of plastics material and out of elastomers, with the exception of the cartridge containing the ceramic resistance element (platinum, screws, . . . ), thereby making it possible to obtain an appliance that is both light in weight and cheap.

There is complete separation, e.g. provided by heat sealing, between the portion containing water or steam and the portion containing electrical power supply and control members, thereby ensuring safety in use.

The use of a ceramic resistance element cartridge 30 inserted in a capillary medium 34 makes the following possible:

minimum thermal inertia for the water around the cartridge. The water is subdivided into drops in the capillary body and therefore enables the appliance to be made ready to deliver steam very quickly (less than 2 minutes);

it is possible to minimize the weight of a small generator, thereby making it suitable for integration in a portable appliance; and the appliance is insensitive to hard water since furring takes place not only around the ceramic cartridge but also on and in the capillary body itself, given that evaporation takes place not only around the ceramic resistance cartridge, but also in the volume of the capillary body, thereby maximizing the number of hours of operation that are possible with tap water, and thus reducing operating costs.

The ceramic resistance element cartridge 30 also makes it possible to raise temperature quickly when starting cold and its power drain diminishes to match the power required for producing the necessary steam, thus saving energy.

Since the ceramic cartridge 30 is self-regulating as a function of requirements associated with the presence or absence of water to be evaporated, it stops drawing power automatically as soon as there is no water left in the appliance. This avoids any need to add control members and safety members, thereby saving both in weight and in cost.

Water never comes into contact with a live active element, thereby making filling safe even under adverse conditions: e.g. plugged in and switched on.

The design of the capillary generator in which the water to be evaporated is contained in the capillary body makes it possible to raise steam regardless of the orientation in three dimensions of the appliance for cleaning windows and smooth surfaces. Also, regardless of the orientation in three dimensions of the appliance for cleaning windows, the steam take-off system makes it possible to take off steam even in the presence of excess water, i.e. water in contact with the walls of the enclosure 22.

The steam generator system is completely sealed all the way to the steam outlet from the appliance, and the two portions 11 and 12 of the case are used as thermal insulators. This makes it possible to avoid heat losses and steam condensing prior to leaving the appliance, and thus makes optimum use of the steam generated possible.

The two portions 11 and 12 of the case are insulated from the steam generator 21 so they are heated relatively little and the handle 13 remains at an acceptable temperature. All of the walls remain cold or at temperatures that are suitable for being held in the hand.

The appliance of the invention also makes various other functions possible and lends itself to various improvements.

Thus, with reference to FIGS. 11 to 14, there can be seen an example of a squeegee 15 of flexible material which includes a bead 151 on its rear edge enabling it to be positioned in complementary grooves formed in the squeegee carrier 14. A groove 155 formed in the body 150 of the squeegee 15 also serves to position the squeegee better in its support. Above all, the active terminal portion 152 of the squeegee shown in FIGS. 11 to 14 includes ribs 153, 154 in the vicinity of its side ends forming chamfered faces and extending substantially perpendicularly to the main face 150 of the squeegee 15. By way of example, the ribs 153 and 154 may extend over a length d of about 20 mm, and may be inclined at an angle a of about 12° for example relative to the longitudinal direction of the squeegee (FIG. 13), and each triangularly shaped rib 153, 154 (FIG. 14) can extend at an angle b of about 30° relative to the plane of the main face 150 of the squeegee 15.

This particular shape of squeegee 15 having lugs 153 and 154 at the side ends of its working edge 152 prevents marks appearing during successive wiping passes.

It may be observed that making chamfered faces with angles of about 10° to 40° relative to the horizontal at the side ends of the active margin 152 but without adding ribs also serves to reduce very considerably any residual vertical marks.

In the description above, the steam distributor 24 is disposed parallel to the axis of the steam generator 21. Other dispositions are possible. Thus, FIG. 15 is a diagram of a steam distributor 24 disposed perpendicularly to the enclosure 22 of the steam generator 21 and FIG. 16 shows a steam distributor 24 at an angle α relative to the axis of the steam generator 21, where α can lie in the range about 30° to about 60°.

In the embodiments shown in FIGS. 15 and 16, the squeegee blade (not shown) can remain parallel to the direction of the steam outlet orifices 17. Insofar as the enclosure 22 of the steam generator can be of small section, it is possible for the appliance to be used with an outer case that does not include a handle, but that can be grasped directly around the body containing the steam generator 21, assuming that temperature levels remain relatively low.

FIG. 19 shows a very simple accessory 100 that can be delivered with an appliance for steam cleaning windows of the kind described above, in particular an appliance that is intended to operate on a low voltage electricity supply of the kind available in motor vehicles, pleasure vehicles, or boats. The accessory 100 consists in a steam collector that can be fixed very simply on the steam diffuser 24 to collect the steam issued by the outlet orifices 17 in a chamber 101. A tubular extension 103 connected to an outlet orifice from the cavity 101 and having a localized steam spray head 104 at its free end enables the collected steam to be injected in concentrated manner for more intense localized cleaning or to heat a liquid. A membrane 102 that is permeable to steam and impermeable to water can guarantee that only steam is injected into a liquid that is to be heated. For hygienic reasons, the extension 103 may be detachable and discardable or it may be sterilizable for repeated use.

Cleaning in general, and the cleaning of windows in particular, is generally associated with an odor coming from the detergents used.

Since steam cleaning is not accompanied by the use of scented detergents, no "clean" odor is given off.

In the appliance described in the present application, it is easy to insert scented elements in the plug 18 of the steam generator 22 that come into contact with the steam so that the odor is conveyed to the outside of the diffuser and onto the cleaned surfaces.

Different plugs may be made available containing various scents that the consumer can purchase as accessories.

In a variant, scented particles can be mixed with the material from which the molded shells 27, 28, and 22 of the steam generator 21 are made, and the scented particles can constitute up to 5% thereof so as to obtain scented steam over a long period of time.

In yet another variant, an additional duct containing scented granules is applied, e.g. by snap-fastening to the outside portion of the diffuser 24, or the snap-fastened duct is made of a plastics material that contains additives giving a selected scent thereto and suitable for being taken to the outside of the duct by the steam travelling in contact with the scented walls.

The invention also makes it possible to add a removable device 130 (FIG. 17) to the portable appliance for cleaning windows for automatically filling the instant steam generator 21 with water. This automatic filling device comprises a plug 118 capable of passing through the case 11, 12 to feed the storage means 34 of a water supply with water via an injection tube 117 mounted on the plug 18 and taking a signal indicating that water feed is required by means of a probe 119 for detecting dryness, and likewise mounted on the plug 118, the flexible lead 120 includes a hose connected to the injection tube 117 and a rechargeable battery 132 or a plug for connection to an electrical power supply, an electrical pump 133, and pump control means 134 connected by cables to the probe, with the electric pump 133 being actuated when the probe 119 detects dryness in the means 34 for storing a supply of water.

A portable case 135 can remain on the ground or can be strapped to the user.

The pump 133 can be switched on automatically when electronic or electromechanical means detect that the ceramic cartridge(s) 30 of the cleaning appliance are not drawing any electrical current, indicating that the porous body 34 is dry. Similarly, the pump 133 can be stopped automatically when the current drawn reaches a predetermined value.

We claim:

1. An electrical appliance for steam cleaning smooth surfaces such as windows, the apparatus comprising a self-contained portable assembly powered by means for connection to an electrical power supply, and comprising a case of plastics material having a front portion and defining a housing, wherein the appliance includes an instant steam generator of low thermal inertia operating at atmospheric pressure and located within said housing, said instant steam generator comprising a capillary storage body for storing all of a supply of water to be converted into steam, said capillary body being compressed around electrical heater means for heating said supply of water and producing steam with low thermal inertia, wherein the electrical heater means comprise a switch and a cartridge including at least one ceramic resistance element, wherein the instant steam generator comprises a first enclosure for holding the capillary body compressed around said cartridge, said first enclosure having perforations for allowing water to come into contact with the capillary body and for allowing steam to escape therefrom and penetrate into a steam distributor opening out via a series of front orifices provided in said front portion of said case, and wherein said appliance further includes a squeegee carrier fitted with a squeegee blade projecting from said front portion of said case of the appliance for wiping away drops produced on a smooth surface to be cleaned by condensation of the steam diffused from said distributor via said series of front orifices.

2. An appliance according to claim 1, wherein the first enclosure is fitted at a first end with a cover serving to position said cartridge within said first enclosure.

3. An appliance according to claim 2, wherein the instant steam generator includes an outer second enclosure cooperating with said cover to form a shell that is sealed with the exception of a steam outlet orifice, centering means being provided to center the outer second enclosure relative to the first enclosure in order to leave an empty space between the enclosures.

4. An appliance according to claim 3, wherein, at an end remote from the end of the first enclosure fitted with a cover, the second enclosure includes removable sealed closure means making it possible selectively to fill the inside of the steam generator with water, to remove excess water, and to close the second enclosure hermetically.

5. An appliance according to claim 3, wherein the steam outlet orifice is formed in a portion of the second enclosure, which extends towards the center of the steam generator and cooperates with a recessed portion of the first enclosure.

6. An appliance according to claim 3, wherein the steam distributor comprises a piece defining an elongate cavity applied to the second enclosure to collect the steam coming from said steam outlet orifice, said steam distributor having a series of nozzles inserted in sealed manner in said series of front orifices formed in the front portion of the case.

7. An appliance according to claim 3, wherein the first and second enclosures of the instant steam generator comprise thin walls made of electrically and thermally insulating material.

8. An appliance according to claim 3, wherein the instant steam generator is positioned in its housing by means of ribs formed in the case of plastics material.

9. An appliance according to claim 1, wherein the first enclosure comprises two perforated half-shells united by link means.

10. An appliance according to claim 1, wherein the case of plastics material comprises two portions provided with means enabling them to be closed together in sealed manner.

11. An appliance according to claim 10, wherein the squeegee carrier is constituted by plate-shaped extensions of the two portions of the case above said series of front orifices, the squeegee blade being clamped between said plates.

12. An appliance according to claim 1, wherein the squeegee member is made of flexible material, such as an elastomer material.

13. An appliance according to claim 12, wherein the squeegee blade has two lateral ends and a terminal portion and the squeegee blade has chamfered surfaces in its terminal portion, in the vicinity of its two lateral ends, said surfaces forming an angle lying in the range 10° to 45° relative to the main direction of said terminal portion.

14. An appliance according to claim 13, wherein the squeegee blade includes ribs in its terminal portion in the vicinity of its two lateral ends, which ribs slope and are disposed essentially perpendicularly to the main face of the squeegee blade, and are located at the level of said chamfered faces of said terminal portion.

15. An appliance according to claim 1, wherein the squeegee blade is made of rigid material to enable it to scrape away semi-solid matter such as ice, snow, or frost that has been partially melted by the steam.

16. An appliance according to claim 1, further including a steam collector for positioning over said series of front orifices to collect the steam in a cavity and to apply said steam in concentrated manner through a tubular extension connected to an outlet orifice from said cavity and including a head at its free end for localized spraying of steam.

17. An appliance according to claim 16, wherein a membrane that is permeable to steam and impermeable to water is interposed between the cavity and the tubular extension that is removably connected to the cavity.

18. An appliance according to claim 1, wherein the squeegee carrier further includes a strip of spongy fabric disposed parallel to the squeegee blade.

19. An appliance according to claim 1, wherein said series of front orifices for diffusing steam, are substantially aligned and substantially parallel to the squeegee blade.

20. An appliance according to claim 19, wherein the case is elongated and is essentially parallel to said series of aligned front orifices for diffusing steam and to the squeegee blade.

21. An appliance according to claim 19, wherein the case is elongated and is essentially perpendicular to said series of aligned front orifices for diffusing steam, and to the squeegee blade.

22. An appliance according to claim 19, wherein the case is elongated and is at an angle lying in the range about 30° to about 60° relative to the mean direction formed by said series of aligned front orifices for diffusing steam and relative to the squeegee blade.

23. An appliance according to claim 1, wherein the case of plastics material also defines a handle situated at the back of the appliance on the side of said housing that is remote from the squeegee carrier.

24. An appliance according to claim 1, further including a removable device for automatically filling the instant steam generator with water, said automatic filler device comprising:

a plug capable of being positioned through the case to feed water to the storage means for storing a supply of water via an injection tube mounted on the plug and to take a signal representative of need for water to be fed by means of a probe for detecting dryness and also mounted on the plug;

a flexible lead including a hose connected to the injection tube;

a rechargeable battery or a plug for connecting to an electrical power supply network; and an electric pump and means for controlling the pump connected by connection cables to the probe, the electric pump being actuated when the probe detects dryness in the storage means for storing a supply of water.

25. An appliance according to claim 1, further including means for adding a scented additive to the steam issued via the series of front orifices.

* * * * *